US006719847B2

(12) United States Patent
Rice et al.

(10) Patent No.: US 6,719,847 B2
(45) Date of Patent: Apr. 13, 2004

(54) MASKING APPARATUS

(75) Inventors: Edwin E. Rice, Ann Arbor, MI (US); Jose P. Munoz, Brighton, MI (US)

(73) Assignee: Cinetic Automation Corporation, Farmington Hills, MI (US)

( * ) Notice: Subject to any disclaimer, the term of this patent is extended or adjusted under 35 U.S.C. 154(b) by 87 days.

(21) Appl. No.: 10/079,151

(22) Filed: Feb. 20, 2002

(65) Prior Publication Data

US 2003/0154919 A1 Aug. 21, 2003

(51) Int. Cl.[7] ..... B05C 21/00
(52) U.S. Cl. ..... 118/504; 118/505
(58) Field of Search ..... 118/504, 505; 427/282

(56) References Cited

U.S. PATENT DOCUMENTS

| | | | |
|---|---|---|---|
| 3,969,553 | A | 7/1976 | Kondo et al. |
| 4,031,268 | A | 6/1977 | Fairbairn |
| 4,147,916 | A | 4/1979 | Fairbairn |

(List continued on next page.)

FOREIGN PATENT DOCUMENTS

| | | |
|---|---|---|
| EP | 459995 | 7/1990 |
| EP | 1077090 | 2/2001 |
| JP | 6307286 | 4/1988 |
| JP | 1039360 | 2/1989 |
| JP | 1147051 | 6/1989 |
| JP | 4120260 | 4/1992 |
| JP | 6101012 | 8/1992 |
| JP | 406065711 | 3/1994 |
| JP | 406128715 | 5/1994 |
| JP | 406287740 | 10/1994 |
| JP | 8302459 | 11/1996 |
| JP | 11106891 | 4/1999 |
| WO | WO9008203 | 7/1990 |
| WO | WO037705 | 6/2000 |
| WO | WO037706 | 6/2000 |

OTHER PUBLICATIONS

Collection of Masking and Painter's Tapes; http://www.cornerhard.com/hardware/Paint_Supplies/Masking_Tape_Drop_Cloths–11; (believed to have been offered for sale in U.S. prior to Feb. 20, 2002).
Description of experimental masking device.
Description of automatically advanced plug device.

*Primary Examiner*—Richard Crispino
*Assistant Examiner*—Yewebdar T. Tadesse
(74) *Attorney, Agent, or Firm*—Harness, Dickey & Pierce, P.L.C.

(57) ABSTRACT

The preferred embodiment of a masking apparatus is adapted to mask the overspray of a coating applied by a spraying device. In another aspect of the present invention, a coated article or part includes a member with an inner surface and at least one opening. The inner surface is sprayed with the coating. In yet another aspect of the present invention, the apparatus includes a deformable masking cup which is operably located adjacent to the opening in the article.

47 Claims, 5 Drawing Sheets

U.S. PATENT DOCUMENTS 4,248,940 A 2/1981 Goward et al.
4,420,543 A 12/1983 Kondo et al.
4,585,481 A 4/1986 Gupta et al.
4,650,404 A * 3/1987 Kusakawa ..... 417/440
4,696,254 A 9/1987 Spindler
4,732,778 A 3/1988 Kawasaki
4,743,462 A 5/1988 Radzavich et al.
4,965,099 A 10/1990 Bornhorst
5,080,056 A 1/1992 Kramer et al.
5,109,150 A 4/1992 Rogers
5,126,165 A 6/1992 Akihama et al.
5,191,186 A 3/1993 Crapo, III et al.
5,201,838 A 4/1993 Roudaut
5,213,055 A 5/1993 Hofbauer
5,271,967 A 12/1993 Kramer et al.
5,334,235 A 8/1994 Dorfman et al.
5,439,714 A 8/1995 Mori et al.
5,442,153 A 8/1995 Marantz et al.
5,468,295 A 11/1995 Marantz et al.
5,508,097 A 4/1996 Hauser et al.
5,573,814 A 11/1996 Donovan
5,707,693 A 1/1998 Vliet et al.
5,714,205 A 2/1998 Marantz et al.
5,796,064 A 8/1998 Rice et al.
5,820,939 A 10/1998 Popoola et al.
5,958,520 A 9/1999 Cook et al.
5,958,521 A 9/1999 Zaluzec et al.
6,060,117 A 5/2000 Pergande et al.
6,073,655 A * 6/2000 Thompson et al. ..... 137/885
6,244,934 B1 * 6/2001 Miyai et al. ..... 451/38
6,258,226 B1 7/2001 Conner
6,291,026 B1 9/2001 Hanson et al.
6,395,090 B1 * 5/2002 Shepley et al. ..... 118/504

* cited by examiner

MASKING APPARATUS

BACKGROUND OF THE INVENTION

This invention is generally related to spraying of articles, and more specifically to an apparatus and method for masking the overspray from a spraying device.

The deposition of metal or ceramic coating to a part using a thermal spraying process is well known. Thermal spraying also known as flame spraying, involves the melting or at least heat softening of a heat fusible material such as a metal, and propelling the softened material in particulate form against a properly prepared surface which is to be coated. The heated particles strike the surface where they quench and bond to the surface. In one type of thermal spray gun, a powder of the coating material is fed axially through a low velocity combustion flame. Alternatively, a thermal spray gun can utilize a high intensity arc to heat inert gas in the gun so as to effect a high velocity gas stream or plasma into which the heat fusible material is injected.

In another type of conventional thermal spray gun, a wire is fed axially through an oxygen-acetylene (or other fuel gas) flame which melts the wire tip. An annular flow of compressed air atomizes the molten wire tip into small droplets or softened particles. The droplets are propelled against a surface by the compressed air. In still another type of traditional thermal spray gun, two wires converge to where an arc between the wire melts the tips to form molten material. The material is atomized and propelled by compressed air against the surface to be coated. All three types of thermal spray are employed to coat various components.

Aluminum alloys are currently being used in automotive components such as internal combustion engine blocks, heads, pistons, bucket tappets and brake rotors to reduce weight and meet governmental fuel economy standards. Other components such as pumps, compressors, transmissions, gear boxes, transfer boxes and axles are also made of aluminum alloys and used in automotive as well as construction, general industry, aerospace and agricultural applications. In addition to aluminum, other materials such as magnesium, zinc, composite metal and polymeric components may be used to reduce cost and improve performance. In most of such applications, there is a need to coat the surfaces of such components in order to withstand thermal-mechanical stresses imposed on them during use.

In one application, such as aluminum engine cylinder blocks, the use of a thermally sprayed coating into the bores of the engine block eliminates the need for inserting cast-iron liners to withstand the sliding contract of steel piston rings or the need to use high silicon content aluminum alloys that require special treatment to precipitate hard wear particles in the bores so as to withstand sliding contact.

When using the thermal spray process, it has been found necessary to mask certain areas of the parts in order to prevent application of the coating in specific adjacent areas. Reasons for masking parts include preventing the coating from entering apertures in the part, maintaining dimensions within a desired range, weight savings and the like.

Three different approaches have been proposed to achieve masking in certain areas. One conventional approach uses a masking tape such as described in U.S. Pat. No. 5,508,097 entitled "Plasma Spray Masking Tape" which issued to Hauser et al. on Apr. 16, 1996. Applying a masking tape to surfaces can be time consuming and labor intensive. Thus, the use of a masking tape in high volume thermal spray operations has not met with great success.

Another approach is to control the thermal spray with a spray attenuation member. Examples of the use of such spray attenuation members are shown in U.S. Pat. No. 5,439,714 entitled "Method for Thermal Spraying of an Inner Surface" which issued to Mori et al. on Aug. 8, 1995 and JP 11106891. However, it is difficult to control overspray at the ends of an inner surface of a part and undesirable non-uniform metal layers can be formed on the inner surface to be coated with this approach.

The third traditional approach is to use masking jigs. Masking jigs are commonly used because they can be positioned by automated equipment to prevent the thermal overspray into specific areas. An external surface masking jig is described in JP 8302459A2. Masking jigs for coating the inside surface of a part such as an engine block, are described in JP 6-287740 and JP 6-65711. Coating the inside surface of a component is more challenging than coating the external surface because of the geometric constraints of accessibility of the thermal spray device and jig into the interior surface area to be coated.

JP 406287740 utilizes a rigid tubular member as a masking jig member. The jig member appears to form a slight gap with the inner diameter of the cylinder bore of an engine block. The masking jig member also appears to move axially in the bore and synchronously with the thermal spray gun as the gun moves in the bore so that substantially all of the overspray is captured in the tubular cavity of the masking member. This unit is complex and requires the tubular jig member to have a slight gap with the surface to be coated to enable the jig to be moved in conjunction with the thermal spray unit. The masking jig must not have a gap that is too large with the inner surface to be coated so as to prevent any substantial overspray past the gap and into masked adjacent areas. However, it may not always be possible to use such a rigid device in cylinder block type applications where the bearing area width-to-bore spacing may limit the size and positioning of such a tubular jig member. Additionally, other geometric constraints at an end of the inner surface of the cylinder bore may prevent forming a slight gap with the inner diameter of the cylinder bore.

Furthermore, JP 406065711A appears to employ a two-part rigid masking jig member with a flange and a tubular portion which can be assembled and disassembled repeatedly for a masking jig. The outside diameter of the assembled masking member appears to have a flat flange that is larger than the inside diameter of the bore and the outside diameter of the cylinder. The masking jig member appears to be assembled within the external end faces of the area adjacent to the crank or bearing journals where the flange is pressed against the bottom end face of the cylinder bore. The thermal spray device is introduced into the bore and the flat flange deflects any overspray back into the cylinder bore. This masking jig most likely has a tendency to form a burr at the interface of the flange and the inner diameter of the bore which is not desirable. Furthermore, the need to assemble and disassemble the masking jig each time the jig is used requires complex and expensive assembly mechanisms.

All of the conventional masking jigs are rigid and non-conformable, and do not permit the use of a rigid masking jig in applications where the distance between bearing caps is less than the diameter of the bore. Thus, there is a need for a conformable jig member that prevents a substantial portion of the overspray from the thermal spray device from deflecting back into the inner surface of the member to be coated and which can deform or conform to fit between bearing cap spaces that are smaller than the bore size of the surface to be coated by the thermal spray.

SUMMARY OF THE INVENTION

In accordance with the present invention, the preferred embodiment of a masking apparatus is adapted to mask the overspray of a coating applied by a spraying device. In another aspect of the present invention, a coated article or part includes a member with an inner surface and at least one opening. The inner surface is sprayed with the coating. In yet another aspect of the present invention, the apparatus includes a deformable masking cup which is operably located adjacent to the opening in the article. The masking cup essentially prevents or minimizes overspray from exiting the article past the end of the opening. Another aspect of the present invention provides a method for masking the overspray of a coating.

Thus, the masking apparatus of the present invention is advantageous over conventional devices since the present invention provides a deformable masking cup that is both reusable (or single purpose in an alternate embodiment) to encapsulate the end of the article opening, and is simple and easy to operate. Another advantage of the present invention is that the masking cup is conformable in order to fit between a bearing cap spacing that is less than the bore size of a workpiece such as an engine block. These and other advantages and benefits of the present invention will become apparent from the following description taken in conjunction with the accompanying drawings and claims.

DETAILED DESCRIPTION OF THE PREFERRED EMBODIMENT

Figure 1:
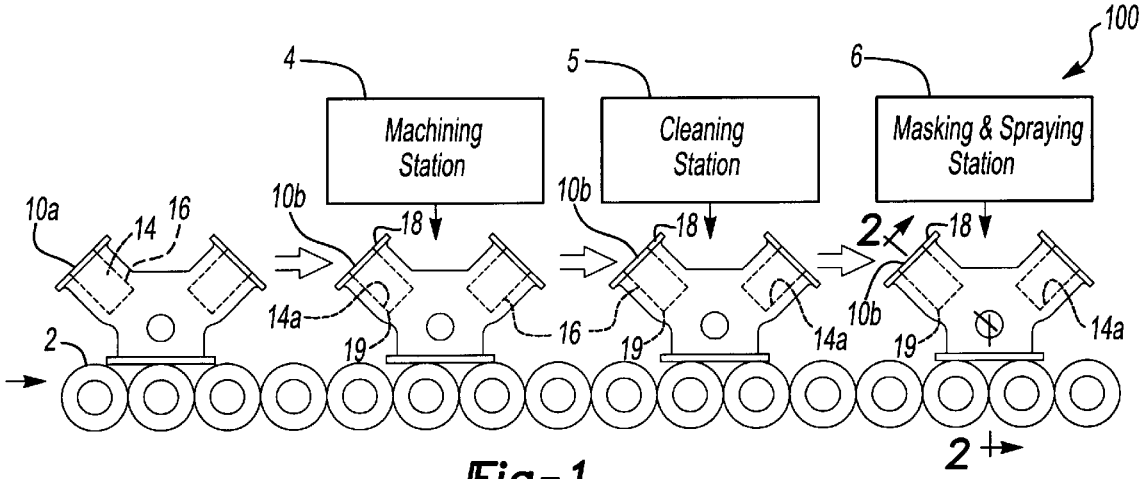
FIG. 1 is a diagrammatic side view showing an engine block transfer line employing the preferred embodiment of a masking apparatus according to the present invention.
Figure 2:
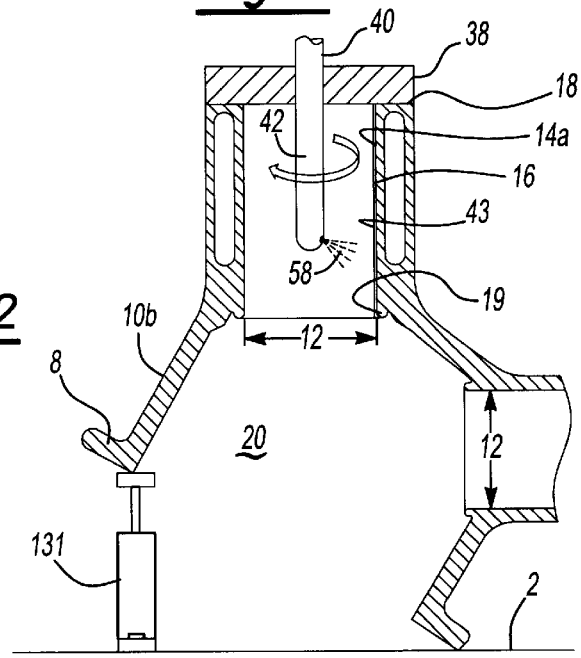
FIG. 2 is a fragmentary cross sectional view, taken along line 2—2 of FIG. 1, showing a thermal spray device employed with the preferred embodiment masking apparatus.
Figure 4B:
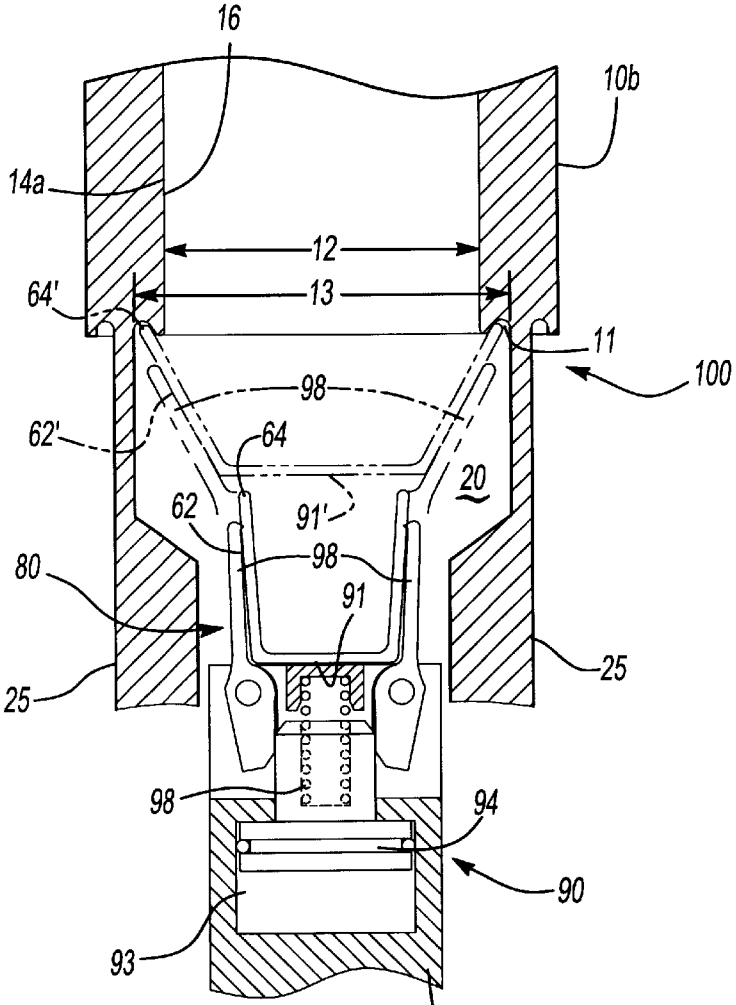
FIG. 4B is a fragmentary cross sectional view, taken along line 4B—4B of FIG. 4A, showing the preferred embodiment masking apparatus.

The preferred embodiment of a masking apparatus or device 100 of the present invention is used in conjunction with an engine block, a thermal spray device 40, and a masking apparatus 100. This is shown in FIGS. 1, 2 and 4B. The practice of the present invention will be described in terms of thermal spray coating of the internal cylinder wall portions of the engine block for a "V" configuration engine. This particular embodiment is selected for illustration purposes only, and it will be appreciated that the practice of the invention is readily adaptable to a number of other components, such as by way of non-limiting examples, pumps, compressors, transmissions, gear boxes, axles, and to other configurations of engine blocks such as V4, V5, V6, V8, V10 and V12 shapes and in-line cylinder designs, as well as other surfaces for automotive and non-automotive workpieces.

FIG. 1 shows an engine block transfer line 2. Transfer line 2 is preferably a power roll conveyor, having multiple rollers automatically driven by one or more electric motors. The engine block is cast from aluminum, a composite or the like, with a plurality of cylinder bores 14 defined by interior surfaces or walls 16, as an engine block casting 10*a*. Engine block casting 10*a* is then placed on transfer line 2 which advances casting 10*a* to a machining station 4. At station 4, engine block casting 10*a* is machined to form a semi-finished engine block 10*b*. In particular, bores 14 are machined so that they are oversized a few thousandths of an inch to create semi-finished machined bores 14*a*. Each cylinder bore 14*a* has a top edge 18, an interior surface 16 and a bottom edge 19. Semi-finished engine block 10*b* is suitably cleaned and degreased at station 5.

After cleaning and degreasing, engine block 10*b* is moved from station 5 to masking and spraying station 6 where thermal spray device 40 is inserted into engine block 10*b* as shown in FIG. 2. To facilitate insertion of spray device 40, engine block 10*b* is automatically tipped by a hydraulic cylinder 131 which upwardly pushes on one side so that bores 14*a* on one bank of block 10*b* are oriented substantially in a vertical plane, in the embodiment shown.

Thermal spray device 40 has a gun head, generally indicated at 42 that creates a molten particle streams 58. Device 40 may be an electric wire arc spray gun as described in U.S. Pat. No. 5,468,295 entitled "Apparatus and Method for Thermal Spray Coating Interior Surfaces" which issued to Marantz et al. on Nov. 21, 1995, or alternatively device 40 may be a powdered metal spray device as described in U.S. Pat. No. 5,334,235 entitled "Thermal Spray Method for Coating Cylinder Bores for Internal Combustion Engines" which issued to Dorfman et al. on Aug. 2, 1994, both of which are incorporated by reference herein.

At least one gun head is mounted on support plate 38 which is movable by a hydraulic lift mechanism (not shown). The lift mechanism includes a stationary support bracket and a hydraulic piston assembly. The hydraulic piston assembly is used to automatically lift and lower thermal spray device 40 into bores 14*a* of engine block 10*b*. Gun head 42 has a tubular extension portion extending toward a nozzle and a body portion. For example, in multiple cylinder applications such as a V8 semi-finished engine block 10*b*, device 40 includes four tubular extensions, four body portions and four deflecting nozzles which are supported in a parallel spaced relationship on support plate 38 in order to coat the inner surfaces of four adjacent bores at the same time. Gun head 42 reciprocates and is automatically, axially driven into and out of the bore while rotating to fully coat the inside of the bore.

A compressed gas source (not shown) delivers compressed gas to the body portion of device 40. The compressed gas is introduced into the nozzle to direct particle streams 58 and to form a layer of coating material 43 radially outwardly onto interior surface 16 of semi-finished machined bore 14*a*. Atomized molten particle streams 58 are generated by each thermal spray device 40 and the gas from the nozzle particle streams 58 from the longitudinally elongated central axis of gun head 42 toward interior surface 16 of semi-finished machined bore 14*a*. An electronic controller (not shown) controls various functions of thermal spray device 40 including the flow of gas in the nozzle. The controller also controls the movement of gun head 42.

The operation of thermal spray gun 42 in only one cylinder bore 14*a* will now be described. The nozzle of gun head 42 is initially located at or near top edge 18 of engine block 10*b* prior to the introduction of the nozzle in bore 14*a*. Thermal spray gun 42 is operated to direct molten particle streams 58 axially onto surface 16 of bore 14*a*. Device 40 is lowered into bore 14*a* by the hydraulic lift and rotated in bore 14*a* until molten particle streams 58 form a layer of coating material 43 on internal surface 16 of cylinder bore 14*a*. When the coating process is complete, the apparatus is turned off and lifted out of bore 14*a* by the hydraulic lift for applying a coating to the next cylinder bore 14*a* or the next bank of the engine block.

Various coating materials may be utilized to form the layer of material 43, such as electrically conductive materials. Alternatively, composite materials may also be utilized to coat the bores. Where the engine block is formed of aluminum, for example, the coating material may be a mild steel which is melted and atomized to form a relatively inexpensive wear resistant layer 43 on internal surface 16 of bore 14*a*.

Figure 4A:
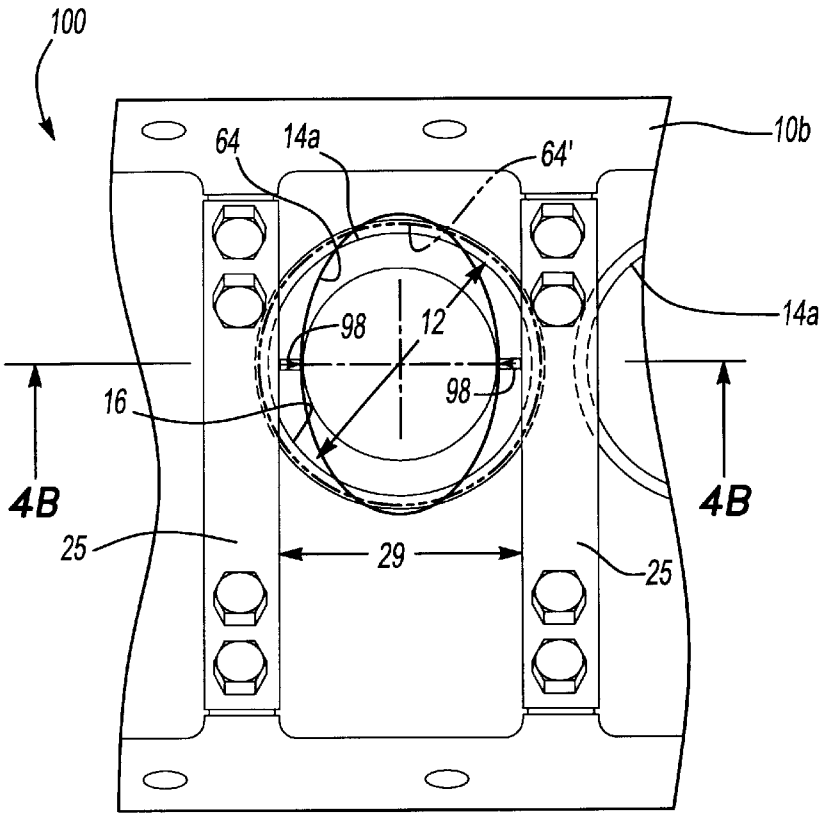
FIG. 4A is a fragmentary bottom view showing the engine block with the preferred embodiment masking apparatus according to the present invention.

Masking apparatus 100 of the present invention is used in conjunction with thermal spray coating device 40 to prevent or at least minimize overspray into a crankcase area 20 when a layer of material 43 is sprayed on internal surface 16 of the cylinder bores of any engine block. When coating material 43 is sprayed on the internal surface 16 in bore 14*a* near bottom edge 19, it has been found necessary to mask crankcase portion 20 of the engine block. If the crankcase portion is not masked, a portion of the overspray of molten particle stream 58 from spray device 40 will deposit on machined bearing surfaces 22 or other high tolerance areas. This is not desirable since it could interfere with the subsequent function of the assembled engine. As shown in FIGS. 4A and 4B, engines are challenging since an axial distance 29 between bearing caps 25 is narrower than inside diameter 12 of bore 14*a*.

Figure 6A:
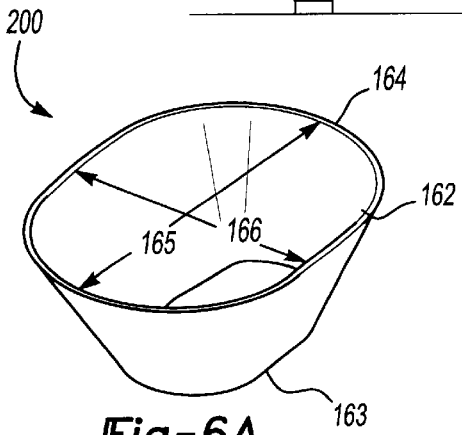
FIG. 6A is a side perspective view showing a mask cup employed in the first alternate embodiment masking apparatus.
Figure 6B:
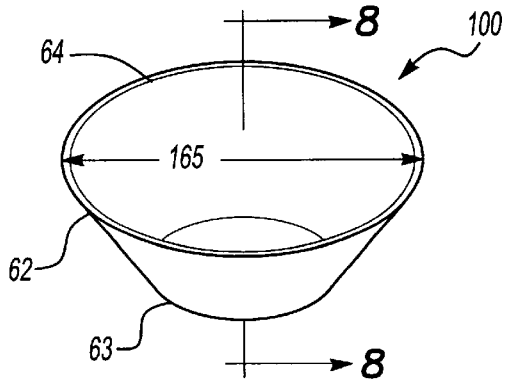
FIG. 6B is a side perspective view showing a mask cup employed in the preferred embodiment masking apparatus.

The preferred embodiment of a masking apparatus 100 is shown in FIGS. 4A, 4B and 6B. Apparatus 100 preferably includes a deformable cup 62, and a masking cup insertion device 80. Masking apparatus 100 is designed to move cup 62 past and through distance 29 between bearing caps 25 and locate cup 62 near bottom edge 19 of bore 14*a* of engine block 10*b*.

Referring to FIG. 6B, a cup 62 has a normally circular open edge 64, with an outer diameter 165 that fits into annular relief 11 in engine block 10*b*, and a closed bottom 63. Because the outer diameter of cup 62 is larger than axial distance 29 between bearing caps 25, masking cup insertion device 80 squeezes or deforms leading, open edge 64 and outer diameter 165 in order to permit the cup to move through axial distance 29 between bearing caps 25. Thus, a pair of rigid fingers 98 press on outer diameter 165 of cup 62 as the cup passes an area adjacent to bearing caps 25 so as to deform cup 62 diametrically to less than distance 29. Deformed cup 62 can thus pass through axial distance 29. After cup 62 is moved past bearing caps 25, the fluid pressure continues to advance a piston 94 in a piston cylinder cavity 93; whereafter the fluid pressure is removed, spring 87 retracts piston 94 and fingers 98 are released so cup 62 returns to its original frusto-conical shape, edge 64 returns to its original circular shape and outer diameter 165 fits into annular relief 11. Annular relief or groove 11 is formed near bottom edge 19 in block 10*b* in crankcase area 20 to provide a positive location for cup 62. Annular relief 11 has a diameter 13 that is larger than inner diameter 12 of bore 14*a*.

Figure 5:
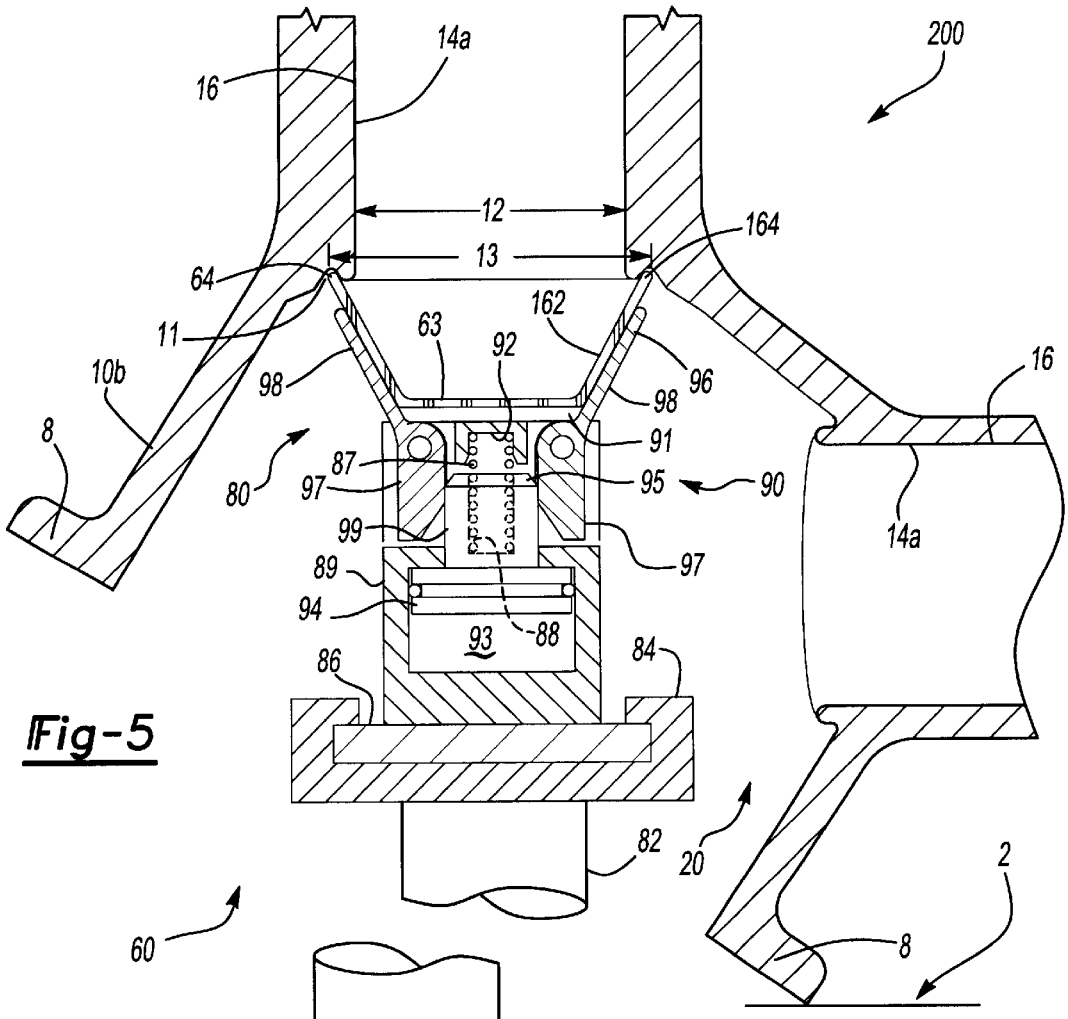
FIG. 5 is a fragmentary cross sectional view, like that of FIG. 2 and 90° to FIG. 3B, showing the engine block with the first alternate embodiment masking apparatus.

As best shown in FIG. 5 for both embodiments, masking cup insertion device 80 includes a strut 82, a lateral slide guide 84 mounted to top of strut 82, and a cup holder 90. A mechanism 351, having a vertical actuator, is mounted to the floor of a manufacturing plant to provide vertical movement of strut 82, or alternately, extends to a robotic arm, with vertical and horizontal jointed strut sections, or alternately at an offset angle. Lateral slide guide 84 is automatically moved by an electric motor or hydraulic cylinder (not shown) approximately ⅜ths of an inch (for a typical V8 engine) to align the masking cup with the appropriate cylinder bore since the cylinder bores in the right bank are offset from those in the left bank to accommodate a later installed cylinder connecting rod. Thus, slide 84 allows a fine motion shuttling of the cup between cylinder bores. Slide 84 and the attached strut mechanism assembly further provide a gross motion clearance to an oil pan rail 8 when device 80 is automatically advanced by way of the fluid powered (hydraulic or pneumatic) cylinder or electric motor insertion mechanism 351, and moved into crankcase area 20. Guide 84 further has a lateral channel with an undercut to capture a plate 86 therein and permit a slight increment of longitudinal movement relative to the engine block and alignment of cup 162 relative to each bore 14*a*.

A cup holder 90 is mounted to plate 86. Cup holder 90 includes a cup supporting cap 91 of a cylindrical housing 89 and the fingers 98 pivotally connected to housing 89. The internal piston cylinder cavity 93 is disposed in housing 89. Cup 62 is mounted on cap 91 of housing 89 by way of screws, if the cup is to be removable, or by rivets. A piston rod 99 projects through an aperture in the top wall of housing 89. Piston rod 99 has tapered distal end 95 that operatively engages fingers 98. Fingers 98 are pivotally attached to housing 89 by pivot pins. Each of fingers 98 include an elongated portion 96 and an enlarged portion 97 with a chamfered end. Thus, when piston 94 is advanced toward the engine block, end 95 of piston rod 99 engages and outwardly cams the chamfered end of each enlarged portion 97, thereby inwardly rotating and holding in position each of fingers 98. Top portion 96 of each finger 98 moves radially inwardly to push on opposite sides of cup 62. Piston rod 99 has an internal cavity 88 into which a compression spring 87 is disposed. An opposite end of spring 87 is secured within a coaxial channel 92 of housing 89. Spring 87 is compressed when the fluid advances piston 94. Thereafter, when the fluid is allowed to exit out of cavity 93 by a valve or port, spring 87 biases piston 94 away from cap 91 of housing 89 so that piston 94 is longitudinally retracted. Thus, as now illustrated in FIG. 4B, retraction of piston 94 allows outward rotation of fingers 98 so cup 62 can return to its normal circular open end view shape.

Cup 62 is made from a resilient, compressible or compliable material such as thin sheet metal including aluminum or steel, a polymer such as silicone or a Santoprene® synthetic elastomer from Monsanto Co., a composite material such as a reinforced polymer or a composite aluminum foil laminated to a fiberglass cloth or another polymer. Alternatively, any material that returns to its original shape after being deformed or squeezed by fingers 98 and can withstand the temperature of the droplets from thermal spray device 40 is believed suitable for practicing the invention.

Functionally, fingers 98 are actuated to rotate inwardly and squeeze the opposite sides of cup 62; this action causes cup 62 to deform from a circular configuration to the somewhat oval configuration thereby permitting open end 64 to fit between bearing caps 25 of the engine block. Thereafter, fingers 98 release cup 62 allowing it to return to its original shape. Cup 62 is then further longitudinally advanced into relief 11 in order to seal on the surface around bore 14*a*. Then, when spray device 40 (see FIG. 2) is operated to coat interior walls 16 of semi-finished block 10*b*, any coating overspray is essentially prevented from being deposited onto the bearing surfaces in crankcase area 20 by cup 62.

Figure 3B:
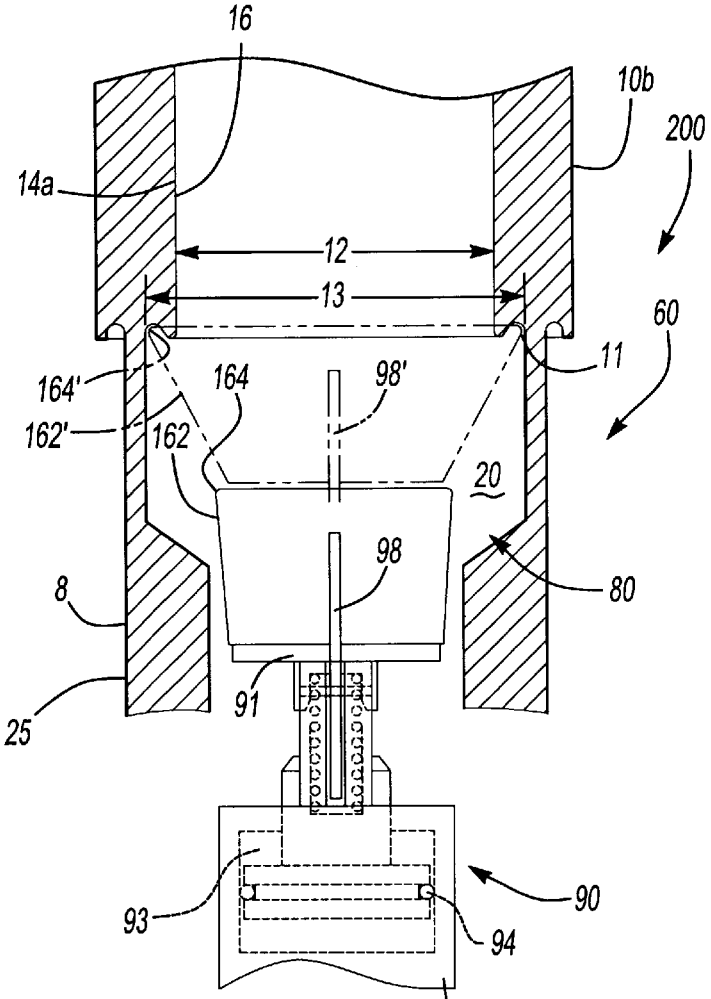
FIG. 3B is a fragmentary cross sectional view, taken along line 3B—3B of FIG. 3A, showing the engine block with the first alternate embodiment masking apparatus.
Figure 3A:
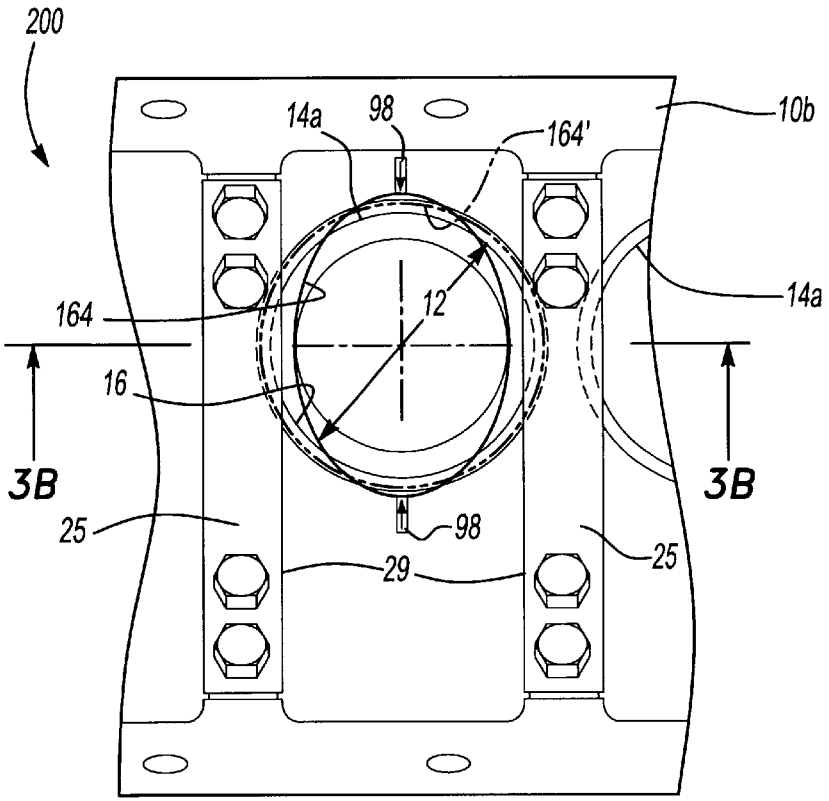
FIG. 3A is a fragmentary bottom view showing the engine block with a first alternate embodiment masking apparatus.

A first alternate embodiment of the present invention is shown in FIGS. 3A, 3B and 6A wherein the first alternate masking apparatus is designated by the reference number 200. The reference numbers will be the same where the elements used in the alternate embodiment are essentially the same as in the preferred embodiment. Deformable cup 162 has a closed, somewhat round end 163 and an oval or elliptical open, wider end 164 in its natural state. Oval open end 164 has a major axis 165 and a minor axis 166. Minor axis 166 is in alignment with the longitudinal axis of crankshaft. Minor axis 166 is less than axial distance 29 between bearing caps 25. Furthermore, major axis 165 is larger than an inner diameter 12 of cylinder bore 14*a*. During insertion after clearing the bearing caps, oval open end 164 of cup 162 is deformed by fingers 98 to a circular end view shape, thereby permitting cup 162 to fit in and generally seal against annular relief 11 by masking cup insertion device 80. In all other aspects masking device 200 operates as in the preferred embodiment.

Figure 7A:
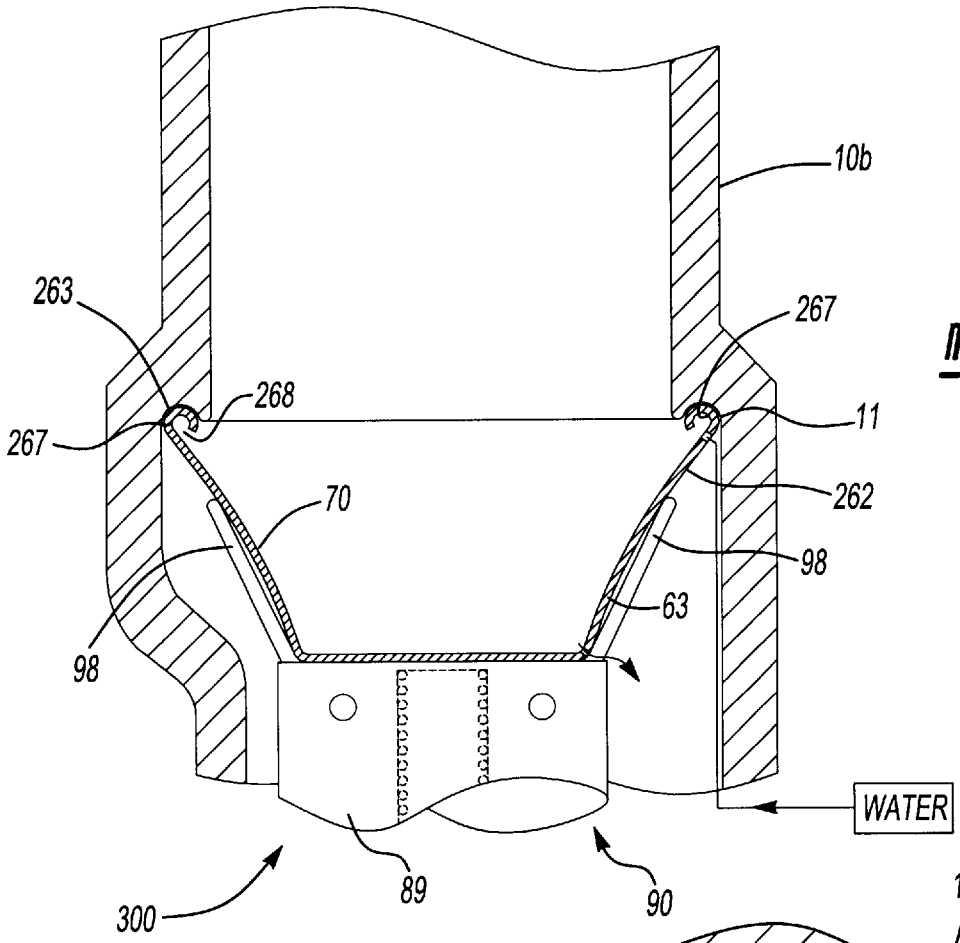
FIG. 7A is a fragmentary cross sectional view, similar to FIG. 3B, showing a second alternate embodiment masking apparatus according to the present invention.
Figure 7B:
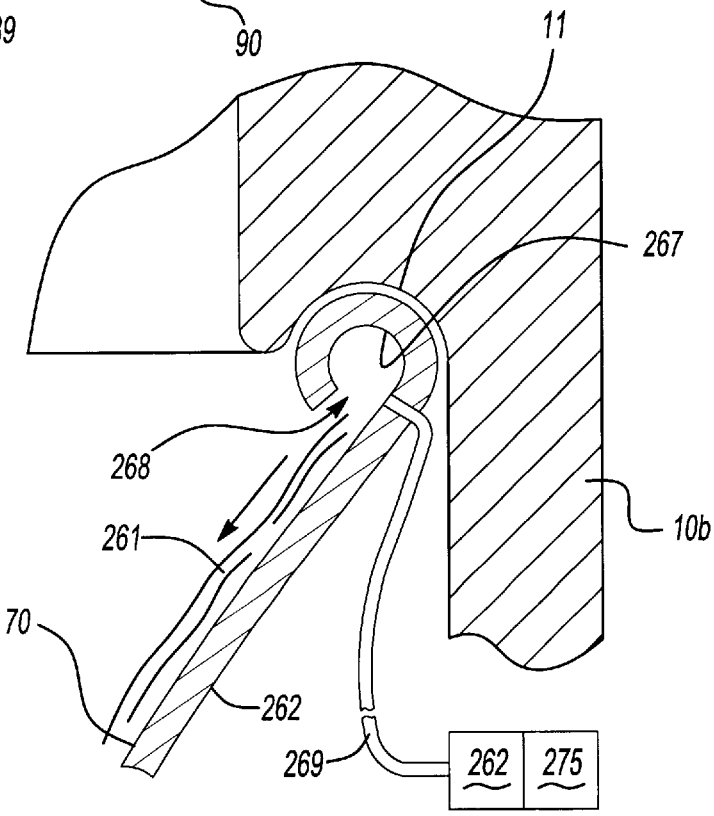
FIG. 7B is an enlarged cross sectional view showing the end of the second alternate embodiment masking apparatus and engine block.

A second alternate embodiment of the present invention masking apparatus 300 is shown in FIGS. 7A and 7B. The second alternate embodiment cup 262 is designed with a fluid passage 267 formed around the rim of an open end 263. A fluid channel or passage 267 is defined as a mostly circular or C-shaped cross-sectional shape by an inwardly turned flange with a gap 268 formed between the wall of cup 262 and edge of passageway 267. The top edge of passage 267 which corresponds with open end 263 fits into annular relief 11 of engine block 10*b*. Fluid 261 is introduced into passageway 267 through a port which is connected by a flexible line or hose 269 to a fluid source including a pump 273 and a tank 275. Fluid 261 is preferably a liquid but alternately any suitable fluid such as air or a detergent solution may also be used. Gap 268 is nearly closed when fluid 261 is not under pressure. However, gap 268 increases in size when pressurized fluid 261 is introduced into passageway 267. Pressurized fluid 261 flows through gap 268 and along inner walls 70 of cup 262 and out of an aperture in bottom end 63. This prevents the thermal spray droplets from adhering to walls 70 of cup 262. It is also envisioned that the constant gap 268 may be replaced by spaced apart holes in the otherwise closed passage 267. The fluid is drained through an exit tube adjacent the bottom of the cup. In all other aspects the second alternate embodiment operates the same as in the preferred embodiment.

Figure 8:
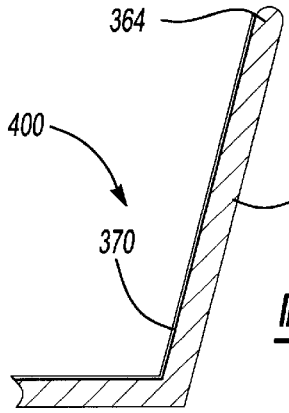
FIG. 8 is a fragmentary cross sectional view showing a mask cup employed in a third alternate embodiment masking apparatus according to the present invention.

A third alternate embodiment of the present invention masking apparatus 400 is shown in FIG. 8 where cup 362 is the same as any of the other embodiments disclosed herein except that cup 362 has a coating 370 on its inner surface to reduce the adherence of the thermal spray droplets. Coating 370 also facilitates cleaning of inner walls 70. For example, coating 370 can be a Teflon® material from E.I. DuPont de Nemours and Co. or a mold release such as that disclosed in U.S. Pat. No. 6,291,026 entitled "Method for Forming a Mold-Release Coating" which issued to Hanson et al. on Sep. 18, 2001, and is incorporated by reference herein. Similarly, if cup 362 is made of a polymer such as silicone or a thermoplastic elastomer, cup 362 may be coated with a thin layer of aluminum or lined with an aluminum insert. A spring steel cup 362 with a polymeric lining can be used. In all other aspects, the third alternate embodiment operates the same as in the preferred embodiment. Cups 62, 162, 262 and 362 may be reusable with periodic cleaning or single purpose wherein the cup is removed and discarded after a number of uses.

While the invention has been described with reference to many embodiments, it will be appreciated that the invention is susceptible to modification, variation and change without departing from the proper scope or fair meaning of the subjoined claims. For example, the apparatus and method may also be used in other applications and other materials and part configurations can be substituted for those disclosed. Any automotive, machine tool, aerospace, appliance or other workpiece part having holes or even flat surfaces that must be free of paint or any other coating can employ the present invention masking apparatus. Furthermore, other coating processes, whether thermally sprayed or not, can be used with the masking apparatus of the present invention; for example, the present invention can be used with robotic paint spraying guns. Moreover, it is envisioned that four or more fingers, multiple compressing members of other shapes, and even fingers that linearly rather than rotatably move can be employed. In another alternate arrangement, other mechanical linkages, cams and cables, or electromagnetic driven members can be used to deform the masking cup. It is intended by the following claims to cover these and any other departures from the disclosed embodiments which fall within the true spirit of the present invention.

The invention claimed is:

1. An industrial masking apparatus comprising:

a deformable sealing member having a substantially enclosed cup-like shape; and a device mounted to the sealing member, the device including an automatic actuator operable to advance the sealing member;

the automatic actuator being operable to cause deformation of at least a portion of the sealing member from a first shape to a second shape before the sealing member engages a workpiece.

2. The masking apparatus of claim 1 wherein the sealing member is resilient so as to return to its first shape when allowed by the device.

3. The masking apparatus of claim 2 wherein:

the sealing member has an open distal end, an annular side wall and a bottom wall; and the walls substantially preventing a sprayed coating from passing beyond the sealing member.

4. The masking apparatus of claim 2 wherein a majority of the sealing member is a polymeric material.

5. The masking apparatus of claim 1 wherein the device includes at least a mechanical element that is movable from a first position to a second position in order to deform the sealing member when the mechanical element is driven by the automatic actuator.

6. The masking apparatus of claim 5 wherein the automatic actuator includes a piston and a piston rod, and fluid pressure operably moves the piston which causes the piston rod to move the mechanical element between its positions.

7. The masking apparatus of claim 5 wherein the device includes a housing, and the mechanical element operably rotates relative to the housing when driven by the automatic actuator.

8. The masking apparatus of claim 5 wherein the mechanical element includes an elongated finger, a pivot and a camming section, and the camming section operably causes the finger to rotate about the pivot.

9. The masking apparatus of claim 1 further comprising a power train part having a bore, the sealing member contacting the part adjacent the bore to minimize a coating from transferring from one side of the sealing member to the opposite side of the sealing member.

10. The masking apparatus of claim 1 wherein a majority of the sealing member is metallic.

11. The masking apparatus of claim 1 wherein the first shape of the sealing member has a smaller dimension than the second shape of the sealing member, with the dimension being measured at a leading opening edge of the sealing member.

12. The masking apparatus of claim 1 wherein the sealing member operably masks overspray from a coating.

13. The masking apparatus of claim 1 wherein the sealing member is disposable and removably attached to the device.

14. The masking apparatus of claim 1 wherein the sealing member is substantially frusto-conical when in one of the shapes.

15. The masking apparatus of claim 1 further comprising a cleaning fluid operably flowing within the sealing member.

16. A masking system comprising:

a coating application device operable to emit a coating;

a mask operable to deter application of the coating in an undesired area, at least a majority of the mask being flexible; and at least one automatic actuator operably moving the mask relative to an axis of movement of the application device in at least two substantially perpendicular directions.

17. The masking system of claim 16 further comprising a mechanical element movable from a first position to a second position in order to flex the mask when the actuator moves the mechanical element.

18. The masking system of claim 17 wherein the actuator includes a piston and a piston rod, and fluid pressure operably moves the piston which causes the piston rod to move the mechanical element.

19. The masking system of claim 17 further comprising at least a second mechanical element operably moved by the actuator, the mechanical elements operably compressing at least a portion of the mask.

20. The masking system of claim 16 wherein the application device operably sprays the coating.

21. The masking system of claim 20 wherein the coating is heated for spraying.

22. The masking system of claim 16 further comprising a workpiece having raised formations, the mask being flexed to allow its insertion between the formations and against the workpiece.

23. The masking system of claim 22 wherein the mask operably returns to its non-flexed shape when removed from the workpiece.

24. The masking system of claim 22 wherein the mask is in its non-flexed shape when it contacts against a surface of the workpiece to be masked.

25. The masking system of claim 16 further comprising a workpiece having a bore, the mask operably sealing against a surface around the bore when the application device is transmitting the coating inside the bore.

26. The masking system of claim 25 wherein the workpiece is an engine block.

27. The masking system of claim 16 wherein the coating includes metallic material.

28. The masking system of claim 16 wherein the mask is automatically flexed prior to application of the coating by the application device.

29. The masking system of claim 16 wherein the mask has a cup shape.

30. The masking system of claim 16 wherein the majority of the mask is polymeric.

31. A masking system comprising:

a power train part having raised formations and an area to be masked between a pair of the formations;

a mask moveable from a retracted position to an advanced position, the mask having a leading open edge which operably contacts against a surface of the part adjacent the area when advanced; and at least one mechanical member operably deforming the leading edge of the mask prior to the mask contacting the part;

the leading edge of the mask returning to its undeformed shape when fully retracted.

32. The masking system of claim 31 wherein the mask is substantially in its undeformed shape when contacting against the part.

33. The masking system of claim 31 wherein the mask has a cup shape.

34. The masking system of claim 31 wherein the area includes a bore.

35. The masking system of claim 31 further comprising a metal spray coating applied to the part.

36. A masking apparatus comprising:

a coating;

a masking cup operably deterring application of the coating in an undesired area;

a mechanism operably moving the masking cup; and a fluid flowing primarily in the masking cup to assist in removal of the coating from the masking cup.

37. The masking apparatus of claim 36 further comprising a workpiece, wherein the mechanism linearly moves the masking cup toward the workpiece.

38. The masking apparatus of claim 37 wherein the workpiece is an automotive vehicle power train part.

39. The masking apparatus of claim 36 wherein the masking cup includes at least one channel operable to assist in flowing the fluid, the channel having at least a section disposed near an open edge of the masking cup.

40. The masking apparatus of claim 39 wherein the channel is defined by an inwardly turned C-shaped flange.

41. The masking apparatus of claim 36 wherein the mechanism automatically deforms the masking cup.

42. The masking apparatus of claim 36 wherein the mechanism includes a piston and a set of moveable members driven by the piston.

43. The masking apparatus of claim 36 wherein the fluid is a liquid that flows down an internal surface of the masking cup and drains out a bottom of the masking cup.

44. The masking apparatus of claim 36 wherein a majority of the masking cup is flexible.

45. An industrial masking apparatus comprising:

a deformable sealing member having a substantially enclosed cup-like shape; and a device mounted to the sealing member, the device including an automatic actuator operable to advance the sealing member;

the automatic actuator being operable to cause deformation of at least a portion of the sealing member from a first shape to a second shape before the sealing member is fully advanced;

wherein the device includes a mechanical element having an elongated finger and a mechanical conveyor operable to move the finger from a first position to a second position in order to deform the sealing member when the mechanical element is driven by the automatic actuator.

46. The industrial masking apparatus of claim 45, wherein the mechanical conveyor includes a camming section and a pivot, the camming section operable to rotate the finger about the pivot.

47. A masking apparatus comprising:

a coating;

a masking cup operably deterring application of the coating in an undesired area;

a mechanism operably moving the masking cup; and a fluid flowing in the masking cup to assist in removal of the coating from the masking cup;

wherein the fluid is a liquid that flows down an internal surface of the masking cup and drains out a bottom of the masking cup.

* * * * *

UNITED STATES PATENT AND TRADEMARK OFFICE

CERTIFICATE OF CORRECTION

PATENT NO. : 6,719,847 B2
DATED : April 13, 2004
INVENTOR(S) : E. Rice et al.

It is certified that error appears in the above-identified patent and that said Letters Patent is hereby corrected as shown below:

Column 8,
Line 58, after "a" insert -- substantially perpendicular --.
Line 59, "preventing" should be -- prevent --.

Signed and Sealed this

Twenty-eighth Day of December, 2004

JON W. DUDAS
*Director of the United States Patent and Trademark Office*